United States Patent [19]

Harper

[11] 4,068,449

[45] Jan. 17, 1978

[54] TOOL FOR PLACING LIDS ON CUPS

[75] Inventor: Paul W. Harper, Rochester, N.Y.

[73] Assignee: Our Mother of Sorrows Church, Rochester, N.Y.

[21] Appl. No.: 715,937

[22] Filed: Aug. 17, 1976

[51] Int. Cl.[2] ..... B67B 1/04; B67B 5/02; B65B 7/28

[52] U.S. Cl. ..... 53/319; 53/78; 53/328; 53/390

[58] Field of Search ..... 53/319, 328, 322, 323, 53/342, 287, 78, 305, 390, 367, 317

[56] References Cited

U.S. PATENT DOCUMENTS

| | | | |
|---|---|---|---|
| 1,125,041 | 1/1915 | Beadle | 53/367 X |
| 1,193,463 | 8/1916 | Januchowsky et al. | 53/342 |
| 1,878,343 | 9/1932 | Stone | 53/342 X |
| 2,694,517 | 11/1954 | Pennestri | 53/319 |
| 2,731,185 | 1/1956 | Ranney et al. | 53/317 |
| 2,914,901 | 12/1959 | Kinsley, Jr. et al. | 53/367 X |
| 3,715,865 | 2/1973 | Davis | 53/319 |

*Primary Examiner*—Othell M. Simpson
*Assistant Examiner*—Horace M. Culver
*Attorney, Agent, or Firm*—Stonebraker, Shepard & Stephens

[57] ABSTRACT

A tool for placing a lid or closure on a cup or container, such as a cardboard or plastic cup containing hot coffee delivered to a customer at a take-out food service establishment. The preferred form of tool has a upright handle with spring-loaded telescopic sections and a bottom member or shoe which fits snugly within an upstanding marginal flange of the lid with which this tool is to be used, so that when the tool is raised, the lid will be carried with it. The tool is manipulated to place the lid on the top of the cup filled with coffee or other liquid. Downward motion of the handle portion of the tool moves the telescopic portions relative to each other, first compressing a spring, and then suddenly releasing the spring with a hammer effect, to drive the lid into mating engagement with the cup, with just the right amount of pressure to produce adequate sealing between the cup and the lid, without damage to either. Alternative forms of tool, not employing the hammer effect, are also disclosed. In all forms, the lid or closure, at the time it is placed on the cup, is engaged only with the tool, not with the human hand. This eliminates possible contamination from the hand and avoids the danger of burning the hand. The use of the tool enables the lid to be placed more quickly than can be done by the conventional hand-held-lid method, and insures that the lid is properly seated on the cup with the desired uniform degree of pressure required to produce a tight seal.

10 Claims, 11 Drawing Figures

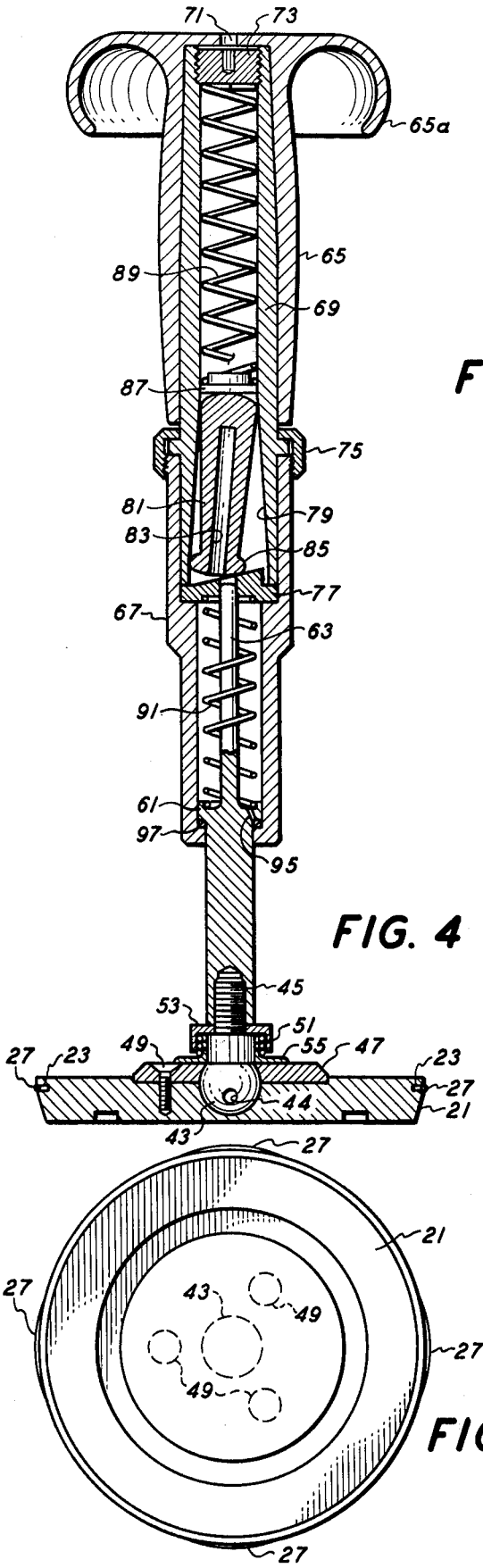
FIG. 4
FIG. 3
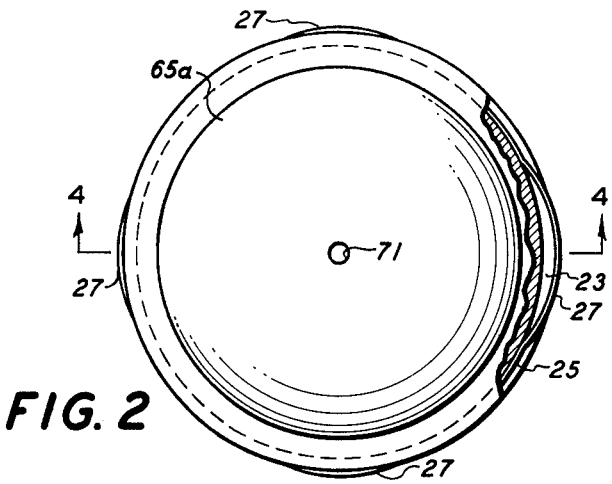
FIG. 2
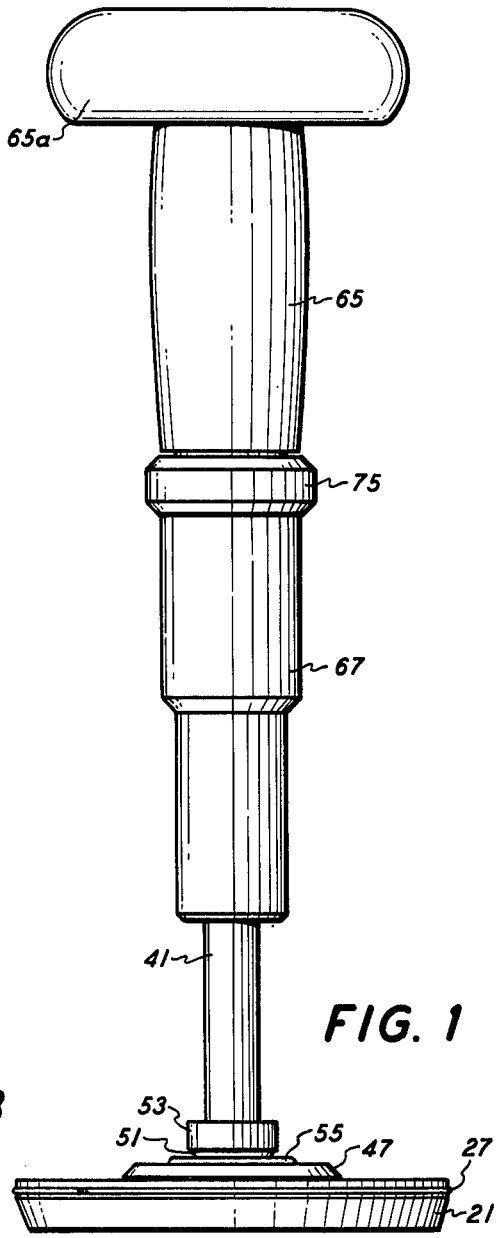
FIG. 1

TOOL FOR PLACING LIDS ON CUPS

BACKGROUND OF THE INVENTION

The present invention provides a tool for placing a lid or closure on a cup or similar container, in a fast, efficient, and sanitary manner. Conventionally, lids have been placed on cups entirely manually, grasping an individual lid with the fingers of one hand, and placing the lid on the cup, and pressing the lid downwardly either with the tips of the fingers or with the flat of the palm of the hand. According to the present invention, the operation is still manual in the sense that the tool is manipulated by hand, but it is non-manual in the sense that the individual lid is not touched by the hand at any stage of the capping or lid-placing operation.

The use of a tool for placing the lid, rather than handling it with the fingers, has four major advantages. First, it is faster. Second, it saves space and improves the general appearance of the area of the food service establishment where the operation is performed. Third, it is more sanitary. Fourth, it promotes uniformity of sealing.

As for speed, manual capping (putting on the lid) is inherently slow. Lids are shipped to the restaurant stacked in plastic or paper tubes. In the restaurant these stacks are removed from the plastic tubes and thrown helter-skelter into a bin since it would take too much time for the counter girl to separate and remove an individual lid from the stack in the plastic container. Yet, though picking up lids that have been tossed into a bin is faster than picking up lids off a stack, a time-study has shown that an average of 2.2 seconds of time is consumed by picking up a lid from a bin, placing it on a hot-drink container, and engaging it into a sealing position.

By use of the closing tool of this invention, the time required for capping is reduced to an average of 0.7 seconds. Additional time is saved by eliminating the necessity of disassembling the stack so as to place it into the bin.

In the fast-food industry, speed is of utmost importance, especially so during rush hours. Customers object to losing a portion of their lunch break by waiting in line at the cash register, and restaurant owners are therefore obliged to hire additional help during rush hours. While 1.5 seconds may not appear to a large time span, it is an important cost factor when large numbers of customers are to be served during a brief time period.

With regard to space and general appearance, a bin supplied for lids consumes a certain amount of space and space is at a premium in a fast food restaurant. Also, the appearance of a large heap of lids is unattractive. With the present invention, a small circular cut-out in the counter top is the only visible part of a column of lids stacked below the countertop in a spring loaded magazine type dispenser which occupies far less space than a bin of lids. Fast food restaurants are usually located in high priced real estate areas and a saving of several cubic feet of space is therefore an advantage to the restaurant operator.

Regarding the factor of sanitation, the most common way of capping is that of grasping the lid between the thumb and index and middle fingers, the thumb usually touching that lid surface which touches or is near the liquid after closing. The lid is thus lightly placed on top of the container and, in a second operation, grasped around its periphery and depressed on the container to obtain a sealing engagement. Since the same counter girl often handles dirty dishes, rags, and money in the cash register, a situation undesirable from the point of view of sanitary conditions is therefore generally existing throughout the fast food industry. This condition is often noted and objected to by customers.

According to the present invention, the lid is never touched by human hands, except those of the ultimate consumer, and at that the consumer will not touch the lid in an area which contacts the beverage. Since the tool touches only the lid on the outside, i.e., the surface away from the beverage, maximum hygenic conditions are thereby obtained.

With regard to proper sealing of the lid to the cup, it is a well known fact that product quality decreases as the speed of productivity increases during manual operations since the human machine has it obvious limitations. As the rush hour pressure increases and fatigue sets in, more and more carry out beverage containers are improperly sealed. While under normal conditions only a few containers are improperly sealed, during the latter part of a rush hour a great number of containers are sealed in a manner where during subsequent transportation liquid escapes from the container. This is not only attributable to speed and fatigue but also due to the hot air escaping from the vent hole commonly used in lids. This hot air, blowing towards the palm of the hand of the operator, induces an element of fear which counteracts the motive to obtain a proper closure.

It is an important purpose of this invention to overcome all of these above shortcomings, since through the use of this tool the dependence upon human variables in the closing operation is greatly reduced. The tool gives the counter girl a clear signal that proper closure has been obtained. In the preferred version the signal is audible and can thus in addition be discerned by a nearby supervisor, or even the customer himself can hear by the sound that his cup of coffee has been properly sealed. Uniformity of proper sealing is thus obtained regardless of speed of operation, operator fatigue, or poor operator attitude or dexterity.

A basic purpose of this invention is therefore to close and properly and uniformly seal carry out beverage containers by means of a simple, inexpensive yet effective tool which increases capping speed, saves space, enhances appearance, and eliminates spillage by always proper and uniform sealing, all of which reduces costs of restaurant operation, reduces hardships of restaurant employees, and increases the satisfaction of restaurant patrons.

Three of many possible designs of such a tool are outlined as follows:

For proper sealing a certain amount of force is required, depending upon size and configuration of the lid. Since fatigue results from the application of force, especially so under rush conditions, two of the designs embody features of mechanical advantage. In the preferred version, a portable model, a small amount of force applied over a relatively long distance is stored in a spring and then suddenly released in a hammer blow, which delivers far more ultimate sealing force than an operator would be capable of furnishing without such mechanical advantage, especially so over a prolonged period of time. Another embodiment accomplishes the same end by means of a simple lever, which, however requires a tool of a larger size, which is disadvantageous due to space limitations, and also is slower since it requires placing of both cup and lid into the tool. Still another embodiment constitutes the most simple and inexpensive design, which, however, is best used wherever the sealing force required is minimal.

It may be mentioned that the preferred form of the present tool is particularly but not exclusively suitable for use with lids of the type disclosed in my U.S. Pat. No. 3,722,784, granted Mar. 27, 1973. Such lids, as fully explained in the patent, have an upstanding marginal flange which fits snugly within the side walls of the cup, to provide a tight seal between the cup and the lid. Furthermore, at the top of the upstanding flange which mates with the inner surface of the cup, the lid has an outwardly flared flange which, when depressed, serves to release the pressure of the upstanding flange against the inner surface of the cup, thus permitting easy removal of the lid from the cup by a simple upward motion.

With such lids, it is important to place the lid in position on the filled cup with just the right amount of pressure, applied in the right place. If not enough pressure is used, the lid will not seal the cup sufficiently to prevent spillage of the contents. If too much pressure is used, either the lid or the cup or both may be damaged, such as by formation of cracks, again resulting in spillage of the contents. If pressure is applied to the obliquely extending rim of the lid, when attempting to place the lid on the cup, this releases the pressure between the lid and the cup so that the cup is not tightly sealed.

It has already been mentioned that in a busy food service establishment, possibly with lines of customers waiting to be served, the clerk filling orders for take-out beverages does not have much time to give individual attention to each order. Especially if the beverage being served is hot, such as coffee, the clerk tends to avoid or minimize contact with the cup, to avoid being burned, and so is inclined simply to place the lid rather loosely on the top of the cup, without much attention to seating it firmly on the cup in a properly sealed manner. Moreover, the natural tendency is to extend the flat of the hand across the top of the lid and push it down lightly. With lids of the particular type disclosed in the above mentioned patent, this would produce downward pressure on the oblique flange on the lid, thus releasing the lid instead of making it tight.

The preferred form of the present invention provides a tool which the clerk can use in a very fast and easy manner, to pick up a lid from a stack of such lids, and place it on the cup with the right amount of pressure applied in the right place, to produce effective sealing of the lid to the cup, without having to come into contact with the hot cup containing a beverage at a high temperature, and without producing any pressure on the oblique marginal rim or flange of the lid, which pressure, in this particular type of lid, would release it rather than tighten it.

BRIEF DESCRIPTION OF THE DRAWINGS

FIG. 1 is a side elevational view of the tool according to a preferred embodiment of the invention;

FIG. 2 is a top plan of the same, with parts broken away to show additional details;

FIG. 3 is a bottom view thereof;

FIG. 4 is a vertical section taken centrally through the tool, approximately on the line 4—4 of FIG. 2;

DESCRIPTION OF THE PREFERRED EMBODIMENTS

Figure 6:
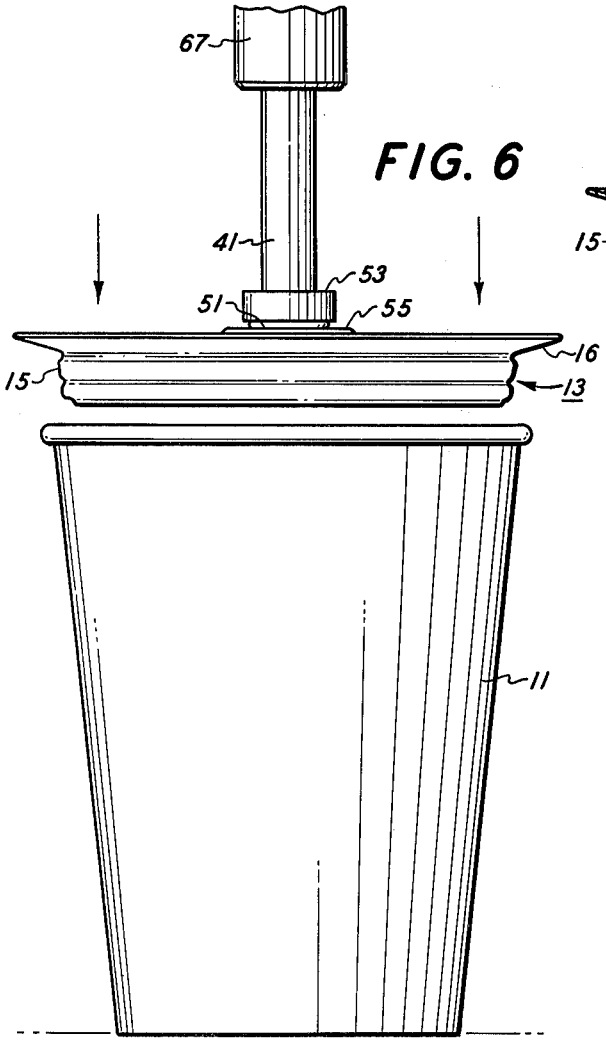
FIG. 6 is a fragmentary side elevation of a cup with the tool in the act of placing a lid on the cup.
Figure 7:
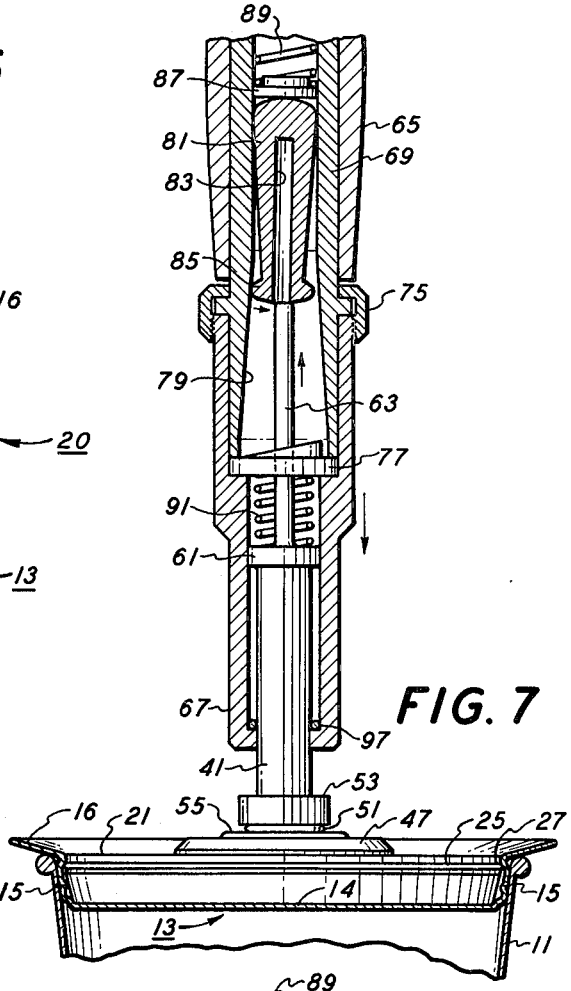
FIG. 7 is a view in vertical section with the lid in place in the top of the cup and with the tool just about to deliver the hammer blow to seat the lid firmly in the cup.

Referring now to FIGS. 6 and 7, there is shown a beverage cup 11 which may be conventional, and a lid or closure indicated in general at 13. This lid has a substantially flat bottom portion 14, upstanding marginal flanges 15 for fitting snugly against the inner surface of the cup near the top edge thereof, and an oblique or inclined marginal flange 16 extending outwardly and upwardly from the upper edge of the flange portion 15. This inclined flange 16 of the present application corresponds to the part 14 in my above mentioned U.S. Pat. No. 3,722,784, referred to therein variously as a radial skirt or as closure releasing or lever means.

When the lid or closure or cover is applied to a cup 11 having a beverage or other liquid therein, the portion 16 should remain in an upwardly extending position as illustrated in FIG. 7. This marginal flange 16 should not be depressed or forced downwardly until it is desired to remove the lid from the cup, because the downward movement of this inclined marginal flange serves to lift the sealing portion 15 in a way to loosen it from the inner surface of the cup 11, thus permitting easy removal of the lid from the cup. However, the natural tendency of a person placing the cover on the cup, particularly if the cup contains a hot beverage, is to press down around the marginal edges of the cover, thus destroying the close or tight fit of the cover against the inner surface of the cup 11. Hence the desirability of having a simple tool which will press downwardly on the flat bottom portion 14 of the lid without forcing the inclined marginal flange 16 downwardly, and desirably also this tool will seat the lid or closure firmly in the upper end of the cup with just the desired and uniform amount of force or pressure, sufficient to cause tight sealing but without such excessive pressure as might crack or split either the cup or the closure. This is an important purpose of the present invention.

Figure 5:
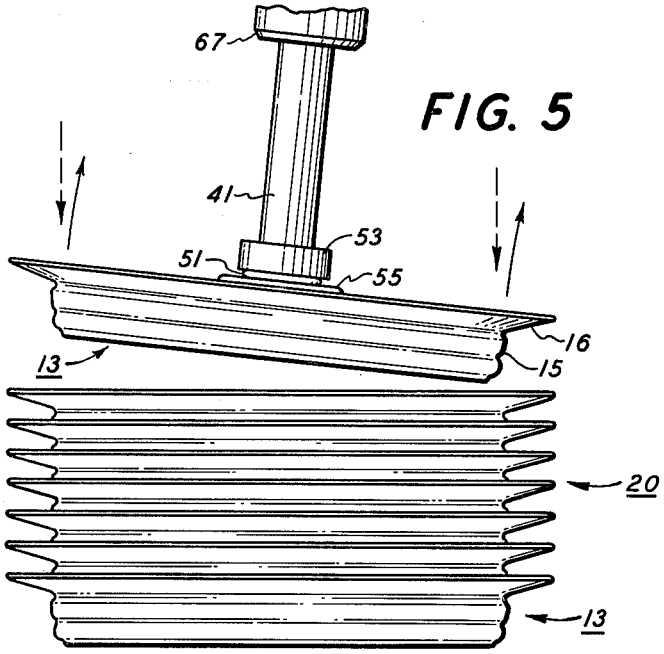
FIG. 5 is a fragmentary side elevation of a stack of lids and the tool in use in lifting the top lid from the stack.

In a food establishment equipped to serve beverages to take-out customers, it is preferable, according to the invention, to have a supply of lids or covers in a stack conveniently located near the place where the cups are filled with the beverage, such a stack being shown in general at 20 in FIG. 5. To save time, it is desirable that the tool for placing the cover or lid on the cup should be able to pick up the top lid from such a stack of lids, without requiring the top lid to be manually separated from the remaining lids in the stack 20. Also, the lid applying tool should hold an individual lid securely, without dropping it, while it is being transferred from the top of the lid supply stack 20 to the top of the filled cup 11 which is to be closed.

To this end, the tool of the present invention comprises a bottom member or shoe 21 (FIGS. 1–4 and 7) which is in the form of a disk fitting loosely within the upstanding flange 15 of a cover or lid member 13, and having a flat bottom for contacting with the flat bottom member 14 of the lid. Around the margin or this shoe 21 there is means for resiliently engaging the upstanding rim 15 of the cover 13, with enough pressure to lift the cover from the pile or stack as shown in FIG. 5 and to carry it safely, without dropping, to a position aligned with the top of the cup 11, as shown in FIG. 6. In the preferred form, this resilient gripping means comprises a circumferential groove 23 extending around the shoe 21 and a spring wire 25 seated in this groove 23 and bulged outwardly at intervals around the circumference, as indicated at 27 in FIGS. 2 and 3. The outwardly bulged portions 27 of this spring wire engage with the inner face of the approximately vertical flange 15 of the lid or cap 13, sufficiently tightly to lift one lid from the top of the pile 20 (FIG. 5) and to hold it while it is transferred to the top of the cup, yet sufficiently loosely so that when the lid is wedged into the cup and the tool is then moved upwardly, the tool will easily separate from the lid, leaving the lid in the cup. In the case of some types of lids or closures, the engagement is simply a frictional engagement. In the case of the particular type of lid disclosed in my above mentioned patent, the engagement of the resilient retainer 25, 27 is with a somewhat undercut portion of the upstanding rim of the lid, latching just below the small inwardly extending bead which is present near the top of the upstanding rim.

Figure 9:
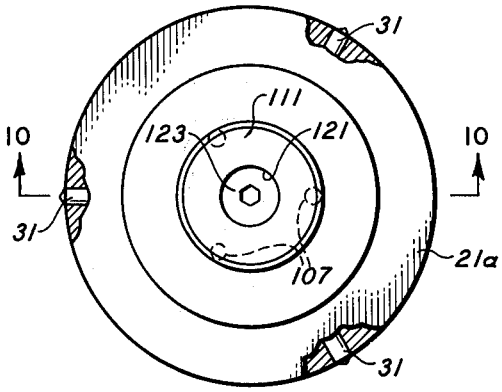
FIG. 9 is a bottom plan view similar to FIG. 3, illustrating a modified construction of the shoe member.
Figure 10:
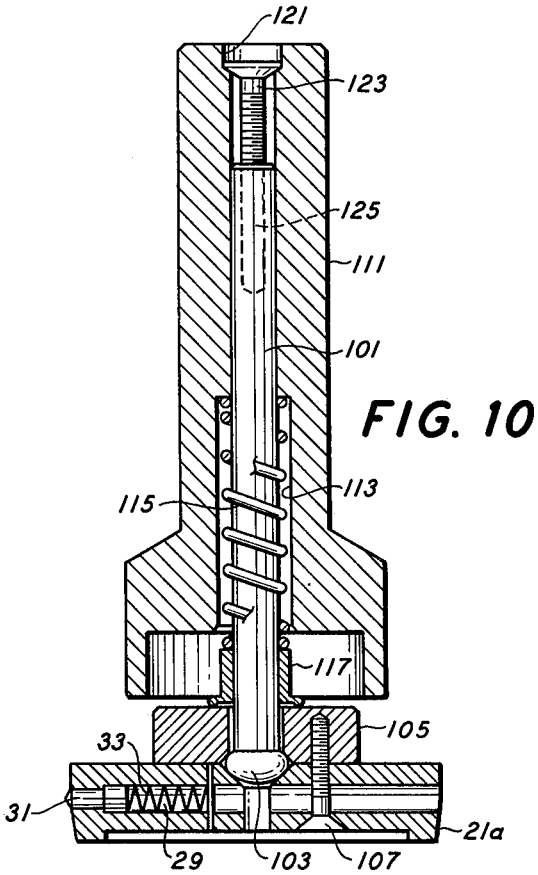
FIG. 10 is a vertical section through a modified form of tool incorporating the modified shoe shown in FIG. 9, the section being taken approximately on the line 10—10 of FIG. 9.

An alternative means for holding the lid resiliently on the shoe is shown in FIGS. 9 and 10. Here, the shoe 21a, instead of having a circumferential groove with a spring wire in it, is provided with a series of radial bores 29, each containing at its outer end a small plunger 31 pressed radially outwardly by a coiled spring 33. The outer ends of the plungers 31, in their extreme or limit position, project a little beyond the periphery of the shoe 21a, as illustrated, and engage the inner face of the upstanding flange of the cover or cap member to accomplish the same purpose as the bulges 27 in the resilient spring wire 25 of the previous embodiment.

The shoe 21 is connected by a universal joint (FIG. 4) to an upstanding shank 41. A member 43 has a spherical or ball shaped lower end, the upper end 45 being threaded into a tapped bore in the lower end of the shank 41. The bottom portion of the ball 43 is seated in a semi-spherical socket portion in the center of the shoe 21, as illustrated. A plate 47 having a spherical surface mating with the upper part of the ball 43 is held in place on the top of the shoe 21 by screws 49. The ball and socket joint can be disassembled by removing the screws 49, thus enabling the plate 21 to be taken off. This plate may be quickly exchanged for another similar plate of different diameter, for use with lids of a different size. The ball 43 has a diametrical bore 44 at an elevation a little below the bottom of the plate 47, so that a pin may be inserted in this bore 44 to serve as a wrench for unscrewing the threads 45 of the ball from the handle shank 41.

To keep the shank 41 normally perpendicular with respect to the shoe 21, yet permit some degree of tilting movement, there is a small coiled spring 51, which may be referred to as an aligning spring, pressing upwardly on a collar 53 held on the shank, and pressing downwardly on a washer-like member 55 resting on top of the member 47. The action of this aligning spring 51 is such that the shank 41 may tilt in any direction relative to the shoe 21, on account of the ball and socket joint, yet whenever it is released it will tend to return to a vertical or perpendicular position relative to the bottom face of the shoe 21.

At some distance above its bottom end, the shank 41 has an enlarged portion 61, and above this the shank continues upwardly at 63 in a portion of considerably reduced diameter. Mounted on this shank for upward and downward telescopic movement relative to the shank, is a handle comprising an upper gripping portion 65, a lower portion 67, both of tubular shape, and an inner tubular member 69. These three parts 65, 67, and 69 are all fixed relative to each other when the tool is in assembled working condition, and all move bodily as a unit upwardly and downwardly with respect to the shank 41 which is attached by the ball and socket joint to the shoe 21. The gripping portion 65 makes a press fit with the inner tubular portion 69. A clearance hole 71 extends through the top of the portion 65, enabling an Allen or similar wrench to be inserted through this hole and into a wrench socket in the top of a plug 73 which is screwed into the top of the member 69. The member 69, in turn, is fixed to the lower handle portion 67 by means of a nut 75 screwed onto external threads at the top of the member 67 and engaging a flange on the member 69, as clearly seen in FIG. 4.

It will be noted that the handle portion 65 is shaped for either palm-of-hand actuation or for circumferential gripping actuation, depending upon the preference of the person using the tool. The upper end of the handle portion 65 has a large diameter flat surface on which the palm of the hand may be placed, the fingers being curved comfortably around the curved marginal flange **65*a*. On the other hand, if the user prefers, he may wrap his fingers circumferentially around that part of the handle which is immediately below the curved marginal flange 65*a***.

Still referring to FIG. 4, a transverse partition member 77 is rigidly clamped between the lower end of the member 69 and a shoulder on the member 67. This partition member 77 has a central axial opening in which the upper end 63 of the shank may slide longitudinally. The upper surface of the member 77 is inclined as illustrated, for a purpose which will be described below. The inner tubular member 69, for some distance upwardly from its lower end, has its inner surface of tapered or frusto conical shape, of decreasing diameter in an upward direction, and then from the top of the tapered section onwardly, it is of uniform diameter.

In the lower tapered portion of the member 69 there is what may be called a striking member or hammer member 81, with a central bore 83 extending from the bottom almost but not quite to the top of this member. The bore 83 is of such diameter that the portion 63 of the shank will slide easily in the bore 83 when they are aligned with each other.

The upper end of the hammer member 81 is of a diameter just slightly less than the diameter of the cylindrical part of the inner wall of the member 69, so as to be able to slide easily therein. The outer surface of the hammer member is of decreasing diameter from the top downwardly, until reaching a point near the lower end, where it again expands as shown at 85 to a diameter substantially the same as the diameter of the upper end.

Resting loosely on the top of the hammer member 81 is a loose plug 87. Above it is a coiled spring 89, reacting downwardly on the plug 87 and upwardly on the bottom face of the threaded plug 73, which may be threaded farther into or out of the upper end of the tubular member 69 to constitute a means for limited adjustment of the tension of the spring 89. Another coiled spring 91 surrounds the shank portion 63 in the lower part of the member 67, reacting upwardly on the lower face of the fixed partition member 77 and reacting downwardly on the shoulder formed between the portions 61 and 63 of the shank member 41. This is a fairly light spring, and simply serves to tend to keep the shank 41 in its lowest position relative to the handle portion 65, 67, 69. A vent hole 95 serves to vent the space in which the spring 91 is located, to prevent creation of any air pressure or any vacuum when the parts move telescopically with respect to each other. An "O" ring 97 surrounds the shank 41 just below the enlarged part 61 of this shank and above the reduced lower end of the member 67, to seal the interior cavities of the tool against entrance of liquid when the tool is being washed.

The action of this form of the invention is as follows: assuming that the parts are in the normal extended position shown in FIG. 4, with both springs 89 and 91 extended to their maximum length, the operator grasps the handle portion 65 either with the palm of the hand over the upper end, or with the fingers surrounding the handle. Preferably the tool will have been left, at the conclusion of the previous capping operation, in a position resting upon the top lid of the supply stack 20. The spring wires 25, 27, in the form shown in FIGS. 1–4, or the spring plungers 31 in the alternative form shown in FIGS. 9 and 10, will engage the inner face of the upstanding flange on the cup lid and latch beneath the undercut portion thereof with sufficient force so that when the operator then moves the tool upwardly, the topmost lid will be lifted from the stack, leaving the rest of the stack, the action being substantially as shown in FIG. 5. Then the operator moves the tool to a position over the beverage cup 11 which has already been filled with coffee or other beverage desired by the customer, and moves the tool downwardly directly over and aligned with the cup, as indicated in FIG. 6.

As a result of this downward movement, the lid or cover first becomes loosely seated in the upper end of the cup 11. Then further downward movement of the handle portion serves to compress both springs 89 and 91, as the handle portion moves down relative to the shank 41. The resistance to such downward telescopic movement is offered mainly by the spring 89, which is the main power spring of the device, the spring 91 being merely a light restoring spring.

At this time the lower end of the hammer member 81 is offset laterally from a central position, because the action of the inclined upper face of the partition 77, at the end of the last previous use of the tool, has displaced the lower end of the hammer member in the manner shown in FIG. 4. Therefore, as the downward motion of the handle relative to the shank commences, the shank portion 63 is not aligned with the bore 83 in the hammer member, and therefore cannot enter this bore. Consequently, as the handle moves downwardly the hammer member 81 is prevented from going down with it, and the hammer member rests on the top of the portion 63 of the shank, thus requiring the spring 89 to be compressed during the downward motion. As the motion continues, the enlarged lower end 85 of the hammer member is forced closer and closer to its central position by the action of the tapered walls 79. FIG. 7 illustrates the parts just before complete alignment of the hammer member with the shank portion 63 is achieved. In this view, the hammer member is still resting on the top end of the member 63, and the main spring 89 is compressed almost to the full extent. At the next instant, as the handle moves very slightly further downwardly relative to the shank, the tapered wall 79 will cam the enlarged lower end 85 of the hammer very slightly further to the right when viewed as in FIG. 7, thus bringing the bore 83 in the hammer into complete axial alignment with the portion 63 of the shank. Then the hammer is no longer forced to rest on the top of the member 63, and it may now slide down the member 63, which it suddenly does, under the influence of the spring 89. It accelerates rapidly during its downward movement, so that it is traveling at a high rate of speed by the time the solid or unperforated top end of the hammer member reaches the top end of the shank member 63 and strikes this shank a sudden downward blow. This hammer blow drives the shank 63, 61, 41 downwardly with just enough additional force to complete the seating of the lid or closure 13 in the top of the cup 11, without damaging either the lid or the cup, but with the proper uniform force to make a tight seal between them.

Figure 8:
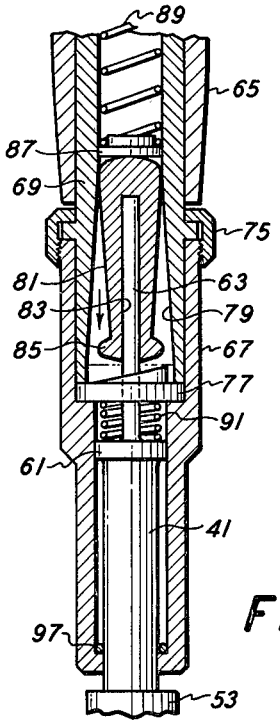
FIG. 8 is a view similar to a fragment of FIG. 7, with the parts at a slightly later stage, the hammer blow being just now delivered.

At the completion of the hammer blow the parts are in the relative positions illustrated in FIG. 8, with the solid material at the upper end of the bore 83 of the hammer resting on the top end of the shank member 63, and with a slight space between the lower end 85 of the hammer member and the inclined member 77. The seating of the lid or closure is completed, so the operator now raises the tool, still grasped in his hand. The shoe 21 disengages itself from the lid as the operator moves the tool upwardly. The resilient lid engaging means 25, 27 (or 31) has sufficient force to retain the weight of a single lid in position on the shoe, but not sufficient force to hold the weight of the lid plus the cup into which the lid is now tightly wedged, plus the weight of the liquid within the cup. Therefore the upward motion of the tool quickly disengages the tool from the assembled cup and lid, without any special attention or effort on the part of the operator.

Also, as the handle portion is lifted, the restoring spring 91 insures that the shank 41 will move downwardly to its lower limit relative to the handle, once the shank and shoe 21 are free of the cup lid. The portion 63 pulls out of the bore 83 in the hammer member, and the residual force in the spring 89, now almost but not quite completely relaxed, shoves the hammer member down against the inclined slope on the upper face of the partition 77, which causes the hammer member to be displaced laterally so the bore 83 is no longer aligned with the shank member 63. In other words, the parts of the tool are restored to the initial or ready position shown in FIG. 4, and the entire tool as a whole is placed on top of the stack of lids, ready for the next lid-placing or capping operation.

By screwing the plug 73 slightly inwardly or outwardly, one may adjust the tension of the spring 89 to exactly the right amount for seating the lid in the cup in the proper manner. This adjustment is made when changing to different sizes of lids, requiring different seating pressures. Also, unscrewing the plug sufficiently far will force the handle grip portion 65 upwardly relative to the inner tubular portion 69, to overcome the press fit, if it is desired to disassemble these parts.

Because of the ball and socket joint 43, 47, it is not necessary for the operator to have the handle of the tool in a strictly vertical position when the lid is being placed on the cup. The operator should keep the tool as nearly vertical as possible at this time, but a slight tilt is permissible, as the shoe 21 carrying the lid can tilt a little one way or the other relative to the handle of the tool, if necessary in order to get the entire periphery of the lid properly seated in the cup.

Reference is now made to an alternative construction illustrated in FIG. 10. Here, there is provision for seating the lid on the cup with a controlled pressure of the proper amount, but without the use of the hammer blow effect which is provided in the preferred embodiment illustrated in FIGS. 1–8.

In the embodiment of FIG. 10, there is a shoe **21*a* serving the same function as the shoe 21 in the previous embodiment, fitting within the rim of the lid and retaining the lid resiliently in position by any suitable resilient retaining means such as the spring pressed plungers 31 illustrated in FIGS. 9 and 10 and already described above, or alternatively using the resilient spring wire 25, 27 previously described in connection with the first embodiment. As before, the shoe 21*a* is connected through a ball and socket arrangement with a shank 101, the lower end of the shank having a ball portion 103 seated in an appropriately shaped depression in the top of the shoe 21*a*. Above the ball portion 103 is a retaining plate 105 engaging the ball and held in position by suitable screws 107**.

A handle portion 111 surrounds the shank 101 and is telescopically movable upwardly and downwardly relative to the shank, through a limited range of movement. This handle 111 has an external diameter such that it may be comfortably grasped by fingers encircling it circumferentially.

The central bore through the handle 111 which receives the shank 101 is counterbored at its lower end, at 113, to receive a spring 115 coiled around the shank 101, reacting upwardly against a shoulder on the handle member and reacting downwardly against the collar 117 slidable on the shank 101 and having an enlarged lower end resting on the flat top of the retaining plate 105. This tends to keep the handle 111 vertical or perpendicular with respect to the horizontal shoe **21*a*, but nevertheless allows the handle and shank 101** to tilt a little in any direction relative to the shoe, if necessary.

At its upper end, the handle 111 is counterbored at 121 to receive the enlarged head of a screw 123 which is screwed into an axial tapped opening 125 at the top of the shank 101. The tapped bore 125 has sufficient length to permit a considerable range of adjustment of the screw 123 into or out of the bore.

The operation of this embodiment of the invention is as follows: the operator encircles the handle 111 with his fingers, extending circumferentially around the handle, with his thumb extending across the top of the handle. As in the first embodiment, the tool is manipulated to pick up one lid or cover from the stack and deposit it in the top of the cup 11. Downward pressure of the handle is continued, compressing the spring 115, until the operator's thumb feels the top surface of the head of the screw 123, rising in its counterbore 121 as the handle 111 moves downwardly. When the operator feels the screwhead, this is the signal to him that he has applied the proper amount of pressure to seat the lid properly in the cup. He then discontinues downward movement, and raises the handle 111, pulling the shoe **21*a*** easily out of the seated or wedged lid.

The degree of pressure exerted in seating the lid on the cup is adjusted by screwing the screw 123 farther into or out of the bore 125. The screw serves the double purpose of limiting the upward motion of the handle 111 relative to the shank 101, thus determining the amount of tension on the spring, and serving as a signal to the operator to discontinue downward motion when placing a lid in position.

Figure 11:
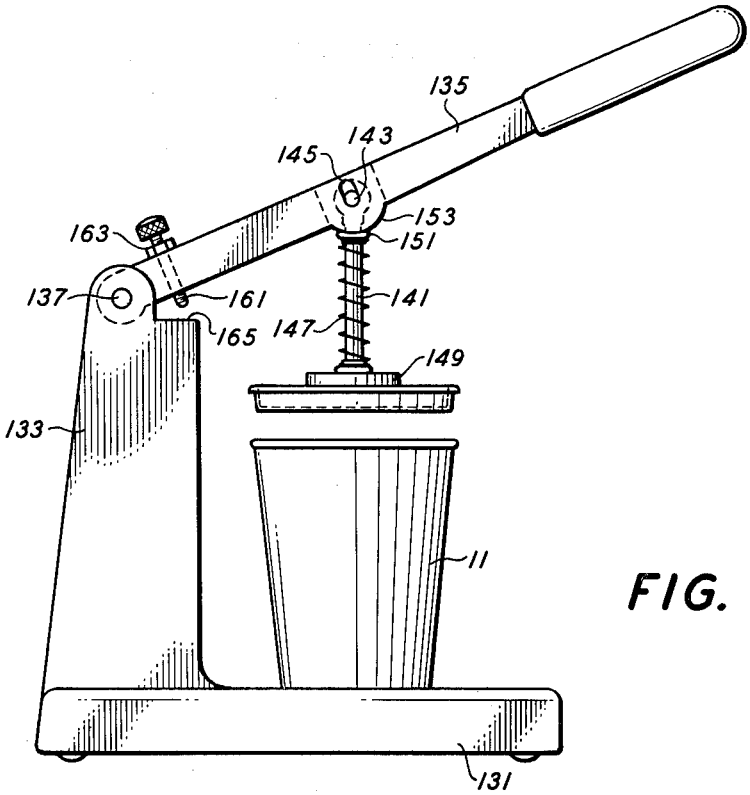
FIG. 11 is a side elevational view of another embodiment of the invention.

A third embodiment of the invention is illustrated in FIG. 11. Here, a small stand 131, suitable for placing on a table top, has an upwardly extending bracket 133 to which a handle lever 135 is pivoted at 137. A shank 141 has its upper end pivoted to a handle 135 by a pivot 143 which, however, extends through a slot 145 to provide a somewhat loose connection. A coiled spring 147 surrounding the shank 141 reacts downwardly on the lid retaining shoe 149 connected to the bottom of the shank 141, and reacts upwardly on a washer 151, the upper face of which is in contact with an arcuate surface 153 on the handle, concentric with the pivot 143 when the pivot is at the lower end of the slot 145. This spring 147 thus tends to hold the pivot 143 at the lower end of its slot.

The shoe here indicated in general at 149 is similar to the lid-retaining shoes previously described, and need not be further shown. It may have a resilient retaining wire 25, 27 like the shoe 21 in the first embodiment, or may have spring pressed retaining plungers 31 like the shoe shown in FIGS. 9 and 10.

A stop screw 161 threaded through the handle 135 near the pivot 137, and held in adjusted position by a lock nut 163, comes down on an abutment surface 165 on the bracket 133, to limit the extent to which the handle 136 may be swung downwardly, in order that, due to the slot 145, the spring 147 and not the force of the operator controls, and therefore produces, uniform sealing pressure.

This embodiment shown in FIG. 11 has some advantages and some disadvantages as compared with the other two embodiments previously described. One disadvantage is that it cannot be used for easy picking up of a top lid from a stack of lids, and in at least most cases a single lid must be individually placed by hand on the shoe. Therefore this embodiment not only is less sanitary but also requires more time than the other versions, especially so since also the filled cup has to be placed into the fixture instead of remaining on the counter top. An advantage, however, is that this tool is always in a certain predetermined location, exactly where the clerk in the shop expects to find it, and the clerk does not have to look for a tool which may have been laid down in the wrong place after some previous use. Also, always the exact amount of pressure is uniformly applied to seat the lid in the top of the cup. If a single lid has been properly placed on the shoe 149, and a filled cup 11 has been placed in proper position, a downward movement of the handle 135 continues until the adjustable stop screw 161 engages the abutment surface 165, thus preventing further downward movement. This stop screw is so adjusted that at the time the motion of the handle is blocked, the lid has been properly seated in the cup under the pressure of the spring 141, the pivot 143 having moved slightly upwardly in the slot 145 but not all the way to the top of the slot.

All three embodiments of the invention thus provide convenient tools for placing lids or closures in cups, without any unwanted pressure applied to the marginal rim of the lid (which would loosen the lid ready for removal, if the lid is of the type disclosed in U.S. Pat. No. 3,722,784) and in fact without requiring the operator to touch the lid manually at all, after it has been placed on the supporting shoe of the tool. In each case, accurately controlled pressure is used in seating the lid in the cup. In each case, the pressure is sufficient for adequate sealing, but not so great as to run the risk of damaging either the cup or the lid. The action is very rapid, and in each embodiment an adequate signal is given to the operator when the seating operation has been completed, so that the operator knows it is finished and that it is not necessary to do anything further so far as placing that particular lid on that particular cup is concerned.

The signal is given by the audible sound of the hammer blow in the first embodiment of the invention, and by the sense of touch in feeling the head of the screw 123 in the second embodiment, and by feeling the contact between the stop screw 161 and the abutment 165 in the third embodiment of the invention.

All three embodiments of the invention are particularly suitable for placing lids or closures of the type disclosed in my above mentioned patent. However, the present invention is not limited to use with such lids, and it is useful with any lid having an upstanding rim which may be engaged by the resilient retaining means at the edge of the shoe, or any lid which may be held on the shoe by any other known means, such as a vacuum cup or a suction chamber holding the lid temporarily on the shoe.

What is claimed is:

1. A tool for applying a lid to a cup, said lid having an upstanding marginal flange shaped for a sealed fit against the inside of said cup, and said tool comprising:

a. a shoe for engaging said lid within said flange;

b. resilient means projecting radially outward from said shoe for engaging the inside of said upstanding flange to retain said lid on said shoe;

c. a shank connected to and rising from said shoe;

d. a handle arranged to be vertically movable relative to said shank and said shoe;

e. spring means operatively connected between said handle and said shank for applying a predetermined maximum downward pressure to said shoe in response to downward movement of said handle relative to said shoe during application of said lid to said cup; and f. means for signalling to the user of said tool that said predetermined maximum pressure has been reached and said lid is properly seated in said cup.

2. A tool as defined in claim 1 wherein said signalling means comprises means for causing a hammer to make an audible sound.

3. A tool as defined in claim 1 wherein said signalling means comprises means coming into contact with a portion of the hand of a person holding said handle.

4. A tool as defined in claim 1 wherein said signalling means comprises stop means for preventing further downward movement of said handle.

5. A tool as defined in claim 1 including a hammer member arranged within said handle to be movable relative to said shank, said hammer member being biased downward by said spring means, and means for suddenly releasing said hammer member to strike a downward blow on said shank under power of said spring means when said spring means reaches said maximum downward pressure.

6. A tool as defined in claim 5 wherein said hammer blow comprises said signalling means.

7. A tool for applying a lid to a cup, the lid having an upstanding marginal flange, said tool having a shoe for engaging said lid within its flange, resilient means projecting outwardly from said shoe for engagement with said upstanding flange to retain a lid frictionally on said shoe, a shank connected to and rising from said shoe, a handle operatively connected to said shank, said handle being generally tubular and surrounding a portion of said shank and being movable telescopically axially with respect to said shank and having a portion suitable for manual grasping, spring means for applying a predetermined and controlled amount of downward pressure to said shank and shoe as a result of downward movement of said handle during the act of placing a lid on a cup, said spring means including a coiled spring within said handle, said tool further including a hammer interposed between said spring means and a portion of said shank, and means for suddenly releasing said hammer to strike a blow on said shank when said handle moves axially relative to said shank to a predetermined extent.

8. A tool as defined in claim 7, wherein said hammer has a bore for receiving a portion of said shank when said bore is aligned with said portion, said hammer being in non-aligned relation to said shank when said handle and said shank are in axially extended relation to each other, and cam means for shifting said hammer laterally as said handle and shank telescope axially with each other until said bore of said hammer becomes aligned with said portion of said shank, whereupon said portion of said shank may enter said bore and said spring means may drive said hammer forcibly along said portion of said shank to strike a blow thereon.

9. A tool for applying a lid to a cup, the lid having an upstanding marginal flange, said tool having a shoe for engaging said lid within its flange, resilient means projecting outwardly from said shoe for engagement with said upstanding flange to retain a lid frictionally on said shoe, a shank connected to and rising from said shoe, a handle operatively connected to said shank, said handle having a portion suitable for manual grasping, spring means for applying a predetermined and controlled amount of downward pressure to said shank and shoe as a result of downward movement of said handle during the act of placing a lid on a cup, a hammer member movable with respect to said shank, and means for suddenly releasing said hammer member to strike a blow on said shank under power of said spring means as said handle reaches a predetermined position during downward movement of said handle relative to said shank.

10. A tool for applying a lid to a cup, the lid having an upstanding marginal flange, said tool having a shoe for engaging said lid within its flange, resilient means projecting outwardly from said shoe for engagement with said upstanding flange to retain a lid frictionally on said shoe, a shank connected to and rising from said shoe, a handle operatively connected to said shank, said handle having a portion suitable for manual grasping, spring means for applying a predetermined and controlled amount of downward pressure to said shank and shoe as a result of downward movement of said handle during the act of placing a lid on a cup, said spring means being tensioned by downward movement of said handle while a lid retained on said shoe is engaged with the top of a cup, and means for signalling to an operator when said spring means has been tensioned to a predetermined extent to seat the lid properly in the cup, said signalling means comprising means for causing a hammer to make an audible sound.

* * * * *